United States Patent [19]

Doherty et al.

[11] 4,022,090

[45] May 10, 1977

[54] ELECTRICALLY ACTUATED PUNCH PRESS

[76] Inventors: Norman R. Doherty, 870 Main St., Farmingdale, N.Y. 11735; Richard F. Doherty, 2 Freshman Lane, Stony Brook, N.Y. 11790

[22] Filed: July 14, 1976

[21] Appl. No.: 705,283

[52] U.S. Cl. ..... 83/162; 83/577; 83/588; 83/596; 83/637

[51] Int. Cl.[2] ..... B26D 5/08

[58] Field of Search ..... 83/577, 576, 575, 588, 83/590, 637, 162; 72/430; 100/266, DIG. 17

[56] References Cited

UNITED STATES PATENTS 3,709,083 1/1973 Doherty ..... 83/575

FOREIGN PATENTS OR APPLICATIONS 451,933 11/1927 Germany ..... 83/575

*Primary Examiner*—J. M. Meister

*Attorney, Agent, or Firm*—Bauer, Amer & King

[57] ABSTRACT

The power stroke of the within punch press results from the electrical interaction of an armature, attached in depending relation from a superposed positioned die set, and a solenoid coil located in the supporting base of the press. In assembling each component of the sub-assemblies consisting of the supported die set and of the supporting base, a positional relation is achieved for each component which in the assembly of the die set onto the base contributes to a proper projected positioning of the armature within the encircling solenoid coil, to thereby achieve the required electrical reaction therebetween without losses or other inefficiencies.

8 Claims, 9 Drawing Figures

ELECTRICALLY ACTUATED PUNCH PRESS

The present invention relates generally to a compact, portable punch press, the portability of which is attributable mainly to the use of a solenoid to actuate an armature through power stroke movement, and more particularly to an electrically actuated punch press with significantly improved operating performance and construction.

As a substitute for a conventional hydraulically or mechanically operated punch press, particularly when cost and portability are factors, an electrically actuated punch press, as disclosed for example in U.S. Pat. No. 3,709,083, is a feasible alternative. While the size of an electrically actuated press is relatively small and compact, consistent with its feature of portability, the latter is not, and should not be, a restriction on the power rating of the press. A punch press that is compactly built, can also deliver optimum power, if properly constructed and operated. In a typical known electrically actuated punch press the armature is advantageously located in a supported position over the work station, and thus also is its cooperating solenoid coil. While this assures the necessary positional relation between these interacting components, the need to provide elevated support to the comparatively heavy solenoid coil places a practical restriction on its size, and thus a practical restriction on the power output of the press.

Generally, it is an object of the present invention to provide an improved electrically actuated punch press overcoming the foregoing and other shortcomings of the present invention. Specifically, it is an object to provide a construction for an electrically actuated punch press which accommodates the solenoid coil in the base thereof, thus minimizing its weight and size as one of the supported components thereof, and in which although the coil has an out-of-the-way location, there is no difficulty in achieving proper positional relation between it and the punch press armature.

A compact, portable, electrically actuated punch press demonstrating objects and advantages of the present invention consists essentially of three assemblies, or self-contained units, which are assembled to provide the press with a compact construction and an efficient mode of operation. These units are a superposed positioned die set, a stroke-powering unit in supporting position beneath the die set, and connecting means for interconnecting the die set and stroke-powering unit together in a predetermined positional relation to each other. The die set comprises a first connecting plate having at least two locating and movement-guiding pins mounted in upstanding relation therefrom, an anvil having openings and disposed in an operative fixed relation adjacent the first connecting plate with said connecting plate pins projected through the anvil openings, a tool holder fixedly mounted adjacent the upper end of the pins in a clearance position from said anvil and in an operative fixed relation thereto as determined by said pins and, completing this unit, is a movement-transmitting member connected in depending relation from the tool holder for urging the tool holder through descending and ascending movements along the pins during functional use of the die set. The second or stroke-powering unit comprises a base plate, an electrically operational solenoid coil and means mounting the coil in a fixed position on the base plate, and a second connecting plate mounted in covering relation over and in fixed positional relation to the solenoid coil. The third unit or connecting means component comprises means located at the interface of the first and second connecting plates adapted to interconnect these plates together in a predetermined positional relation. As a consequence, the depending movement-transmitting member is adapted to project within the solenoid coil for electrical reaction therewith due to the respective positional relationships of the depending member and the coil to said first and second connecting plates and the positional relation of said first and second connecting plates to each other.

The above brief description, as well as further objects, features and advantages of the present invention, will be more fully appreciated by reference to the following detailed description of presently preferred but nonetheless illustrative embodiments in accordance with the present invention, when taken in conjunction with the accompanying drawings, wherein.

Figure 8:
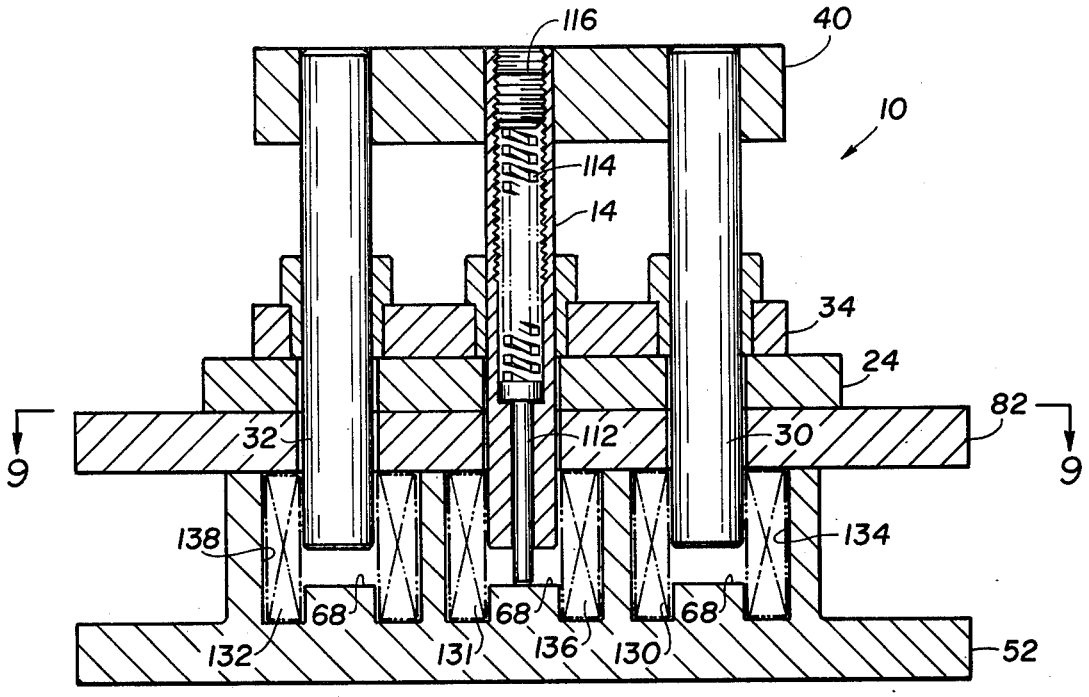
Figure 9:
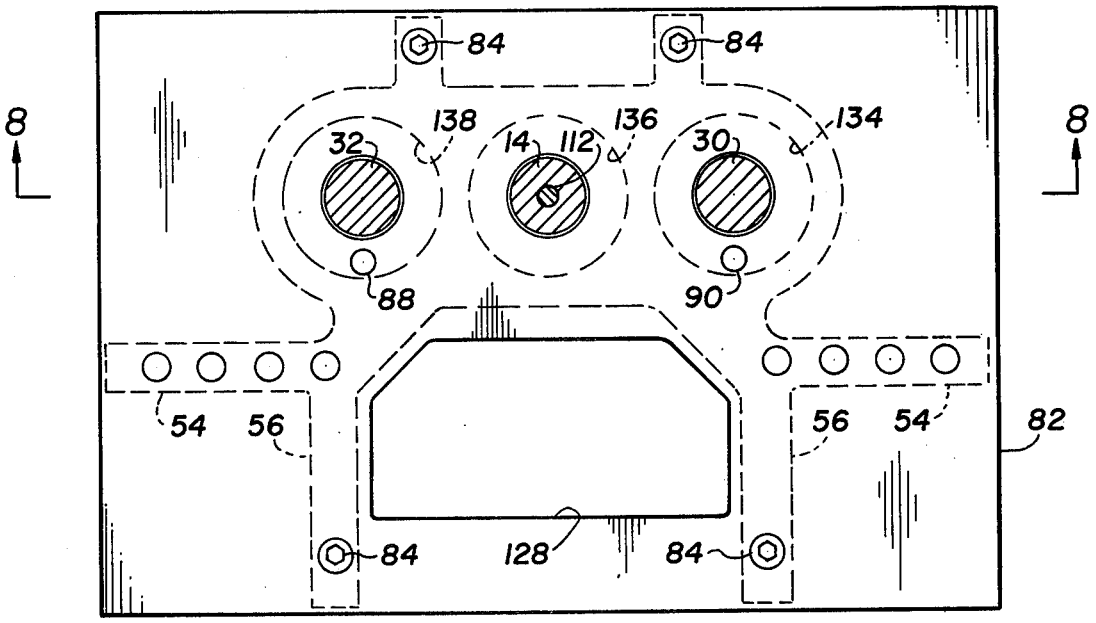

FIGS. 8 and 9 illustrate another embodiment of the punch press. More particularly, FIG. 8 is a front elevational view in section taken along line 8—8 of FIG. 9 illustrating structural details of this embodiment; and FIG. 9 is a plan view projected from FIG. 8 and in section taken along line 9—9 of FIG. 8 showing further structural details.

Reference is now made to the drawings, and in particular to FIGS. 1–7 illustrating a first embodiment of an electrically actuated punch press, similar to that described and illustrated in my prior U.S. Pat. No. 3,709,083, but embodying significant improvements, as will now be described in detail. It should be noted initially, however, that the punch press, generally designated 10, because it is electrically operated, utilizes a solenoid coil 12 which, in a well understood manner, electrically reacts with an armature 14 (see in particular FIG. 2) wherein the armature 14 is urged through movement 16 and this movement 16 constitutes the power stroke of the punch press 10. In accordance with the present invention, the construction and mode of operation of the punch press 10 is of an optimum design to allow the electrical reaction between the solenoid coil 12 and armature 14 and yet contribute to a compact, portable and efficiently operating punch press.

Figure 1:
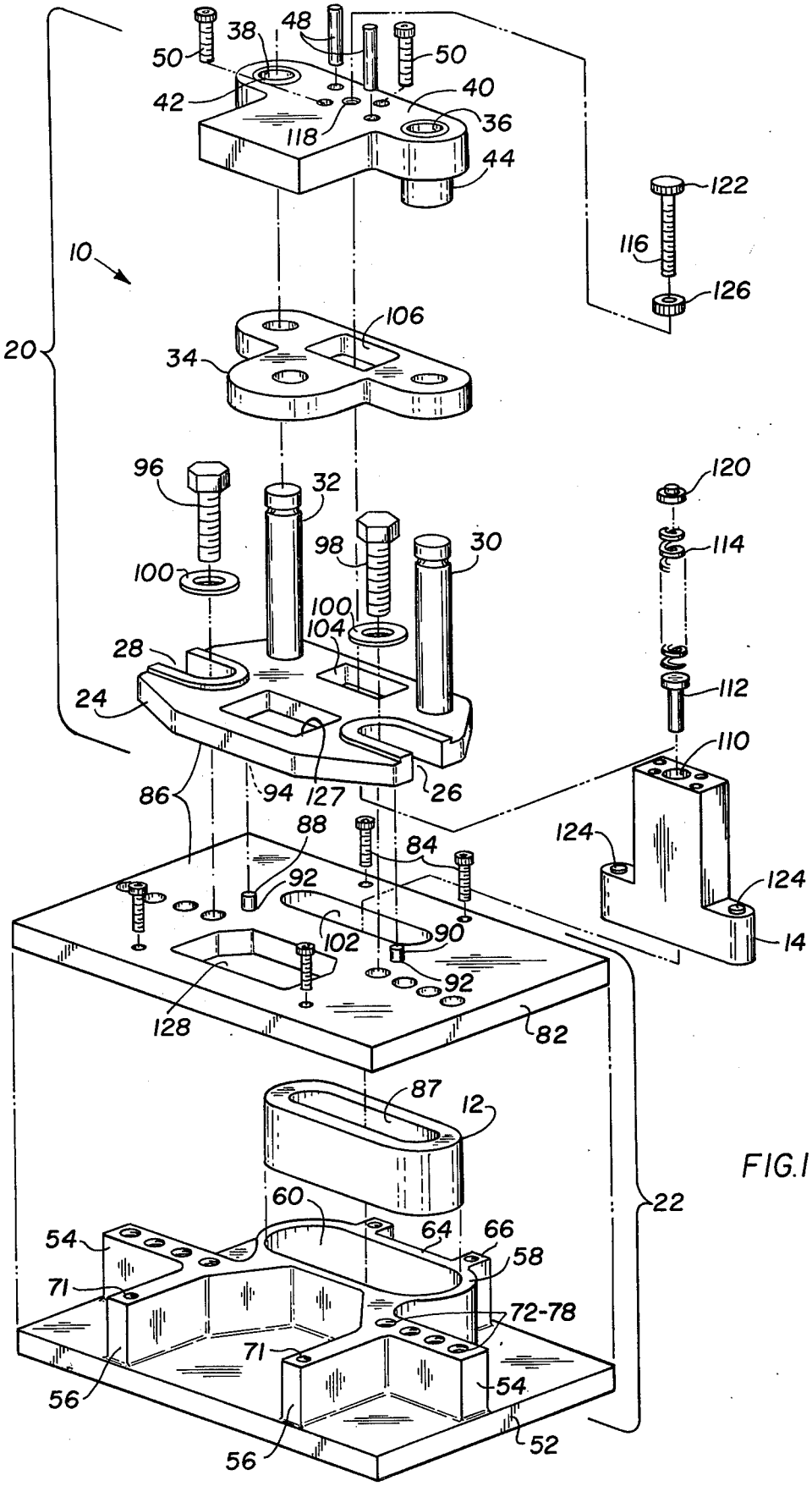
FIG. 1 is an exploded perspective view illustrating the various components of the punch press hereof.
Figure 2:
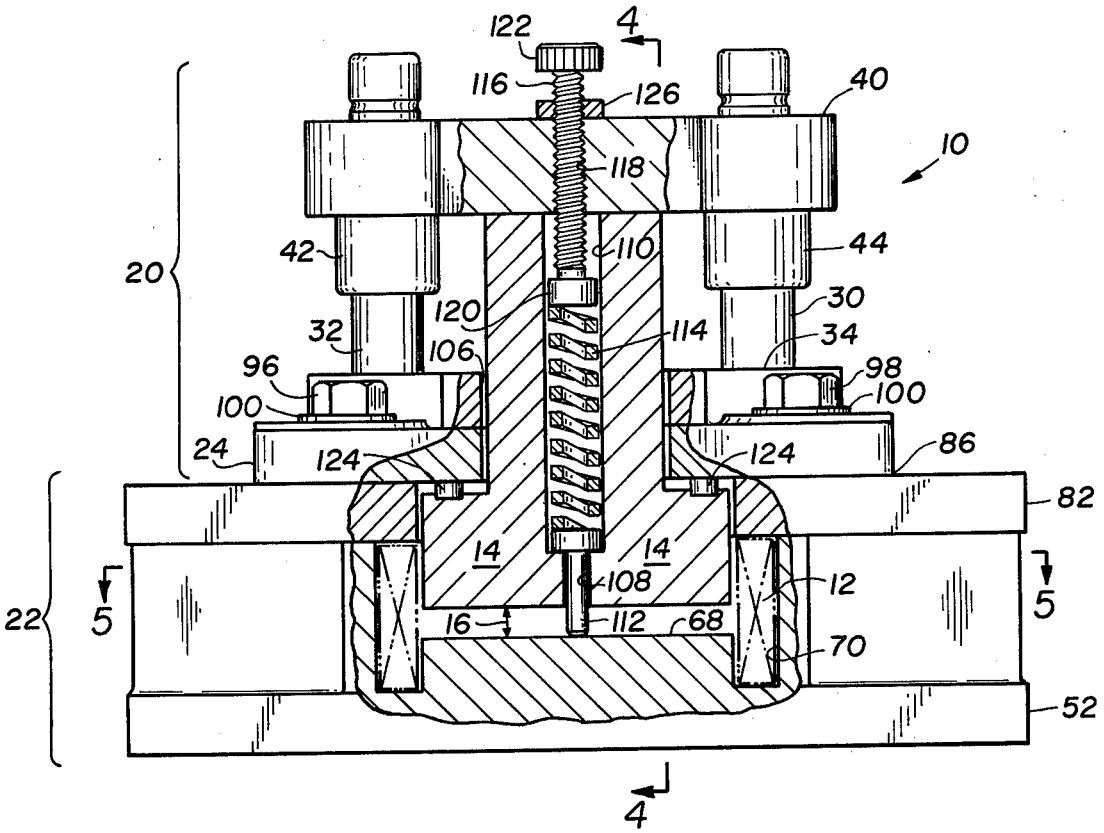
FIG. 2 is a front elevational view of the assembled punch press with the central portion thereof in section to illustrate internal structural features.

The foregoing is achieved in part by construction of the punch press 10 in two integrated and separately distinct units, and then uniting these units into the unitary structure which comprises the punch press 10, and doing so in such manner as to allow the armature 14 connected to one unit to extend therefrom into its necessary projected position within the coil 14 so that the previously described electrical reaction therebetween can take place to effectively power the punch press 10 through its repetitive power stroke 16. One of the units just alluded to is an upper, superposed positioned group of components, generally designated 20 (see in particular FIG. 2), which consists primarily of the die set of the punch press 10. The lower or supporting unit, generally designated 22 in FIG. 2, is designated herein as the stroke-powering unit since it includes the solenoid coil 12. What previously has been referred to as the armature 14 is a movement-transmitting member in that it extends in depending relation from an actual physical connection to the die set 20, or more particularly the tool holder thereof, into close proximate position, as illustrated in FIG. 2, to the solenoid coil 12 so that an electrical reaction can take place, and when it does and thus causes movement 16 in the depending end 14, this is transmitted to the tool holder of the die set 20.

Taking the die set 20 first, the same includes a first connecting plate 24 having opposite side mounting slots 26 and 28. Plate 24 also includes upstanding leader pins 30 and 32, the lower end of which are appropriately fixedly connected to the plate 24 as by being force fit in an opening in the plate 24 and secured thereto, or connected by some other appropriate means. In accordance with the present invention, the pins 30 and 32 provide a combined function of locating other components of the die set 20, as will now be explained, and also in guiding movable parts, namely the tool holder, of the die set through its ascending and descending movements during functional use of the punch press 10.

In practice, positioned in superposed relation upon the first connecting plate 24 is an anvil 34, which may be of a conventional construction often used for die sets. Significant for present purposes is the fact that the anvil 34 is provided with a predictable positional relation to the first connecting plate 24 by virtue of the positioning pins 30 and 32 each being projected through cooperating throughbores 36 and 38 of the anvil 34.

Essentially completing the die set 20 is the tool holder 40, again of conventional design, construction and function. For present purposes it suffices to note that the tool holder 40 includes depending bushings 42 and 44 which receive the upper end of the pins 30 and 32 in such a manner that the tool holder 40 is fixedly connected adjacent the upper ends of the pins 30 and 32 and thus extends in a clearance position above and in facing relation to the anvil 34. As a consequence, material-modifying tooling, such as a punch and female die, or the like, are adapted to be respectively mounted on the tool holder 40 and in the anvil 34 so that in response to the already noted power stroke movement 16 the tool mounted on the tool holder 40 is brought into contact with any material located on the anvil 34 for removal of a portion thereof according to the die shapes, as is well understood, or for some other similar function.

Figure 4:
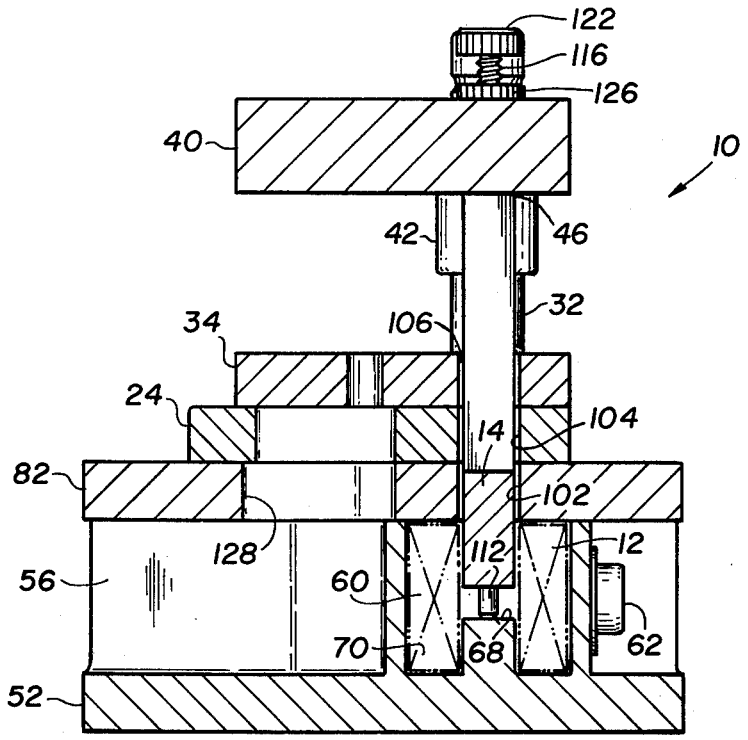
FIG. 4 is a side elevational view, in section, taken along line 4—4 of FIG. 2.

Mounted in depending relation from the tool holder 40 is the previously noted movement-transmitting member 14. Member 14 is actually physically connected at its upper end, as at 46, to the tool holder 40, end 46 being both pinned, as at the locations 48, and bolted, as at the locations 50, to the tool holder 40. As a consequence, member 14 has a proper positional relation to the tool holder 40. In fact, from the description already provided, it should be readily appreciated that member 14 actually has a desired positional relation to the first connecting plate 24 since the pins 30 and 32 which extend from the first connecting plate 24 contribute to the position of the tool holder 40, from which the member 14 is mounted in depending relation. The internal structural features of member 14, as illustrated in FIGS. 2 and 4, will be described subsequently in relation to the return stroke of the member 14 which are provided by these structural features.

At this point in the description reference will now be made to the lower or stroke-powering unit 22. This unit, as is perhaps best illustrated in FIGS. 4 and 5, includes a base plate 52 having an upstanding wall forming intersecting wall sections 54 and 56 at opposite sides, and including a generally oval shaped wall portion 58 located centrally and rearwardly of the wall sections 54, 56. The oval 58 will be understood to be sized to bound a compartment 60 which accommodates the previously noted solenoid coil 12. As is perhaps best illustrated in FIG. 5, and as will be further understood although not precisely shown therein, the electrical leads to the solenoid coil 12 are conveniently electrically integrated with a female socket 62 appropriately supported on a rear wall section 64. Thus, by electrically connecting a plug into the socket 62 electricity is transmitted to the coil 12 to generate the magnetic field which, in a well understood manner, provides the electrical interaction to the magnetizable material of construction of the member 14 to cause the power stroke movement 16 thereof.

Completing the wall configuration, which advantageously is cast as part of the base plate 22, are rearwardly extending wall sections 66. Still further, located centrally of the compartment 16 is a raised surface 68 which cooperates with the oval wall section 58 to define an annular channel 70 about the raised surface 68. Channel 70, as best illustrated in FIG. 2, is adapted to receive the lower edge of the solenoid coil 12 and thus assists in providing a desired positional relationship of the coil 12 to the base plate 52.

Figure 3:
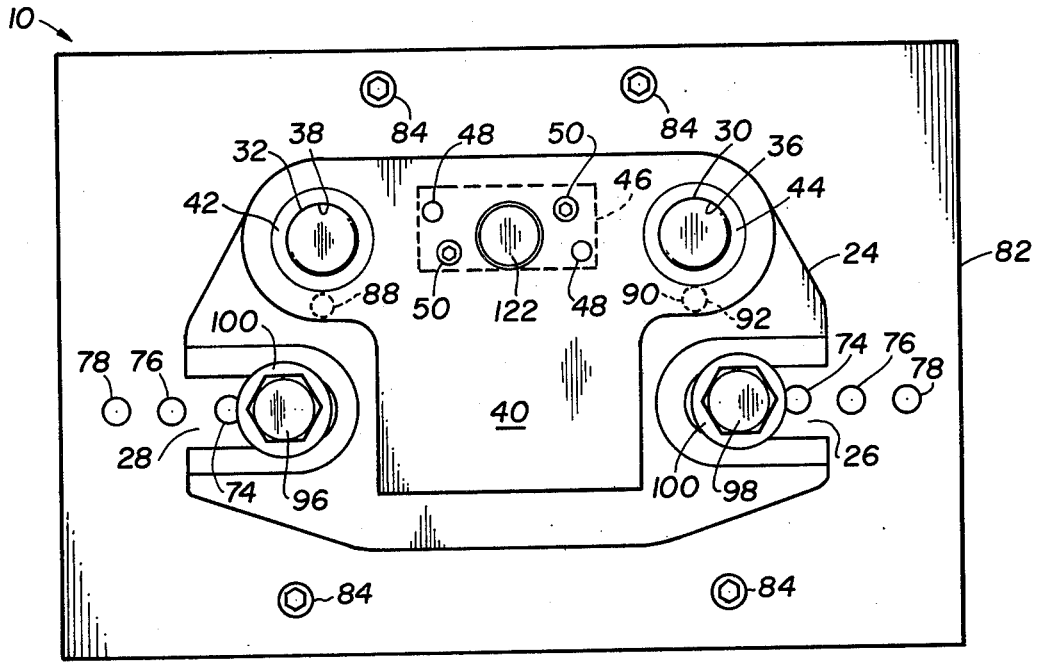
FIG. 3 is a plan view projected from FIG. 2.

Turning again to FIG. 5, it will be noted that the various wall sections have threaded openings therein. Specifically, in the preferred embodiment as illustrated herein, in the wall 56 there is a single threaded bore 71, whereas in each wall section 54 there is a horizontal alignment of four threaded bores, 72, 74, 76 and 78. Two additional threaded bores 80 are each provided in the rear wall section 66. All of the threaded bores just identified are used in attaching a second connecting plate 82 in covering relation over the solenoid coil 12 after it is properly positioned in its compartment 60. In this respect, as illustrated in FIG. 3, four bolts, individually and collectively designated 84, are threadably disposed in the front threaded bores 71 and in the rear threaded bores 80 and are effective in attaching the second connecting plate 82 in a desired positional relationship onto the upstanding wall 58 of the base plate 52.

Figure 6:
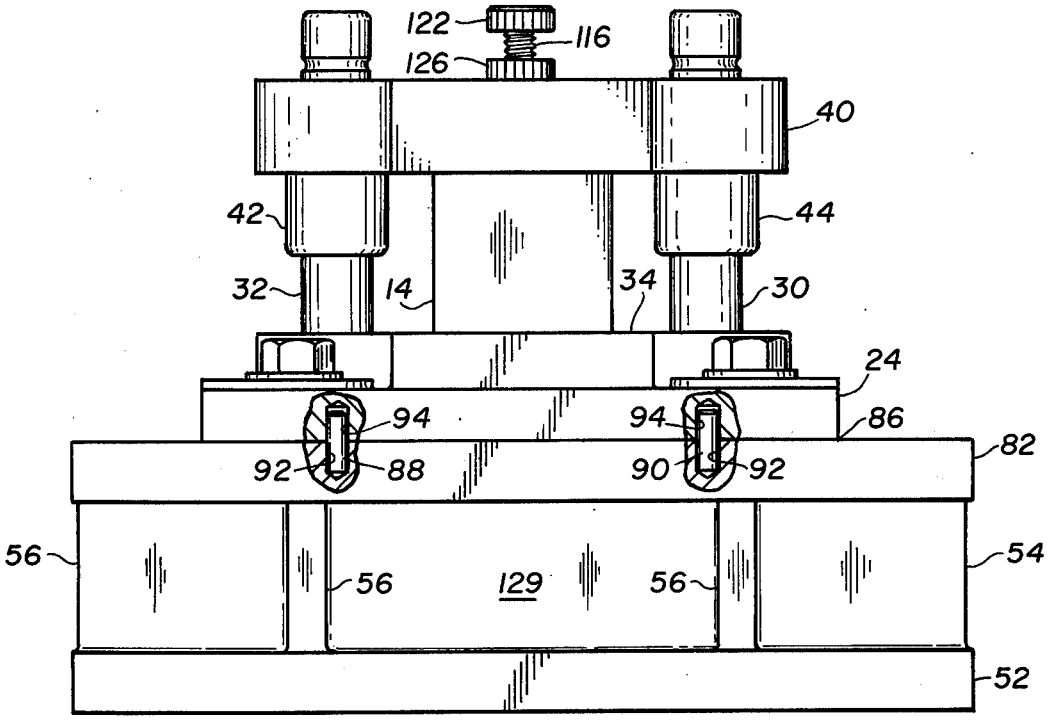
FIG. 6 is a front elevational view, similar to FIG. 1, but with portions in section to more particularly illustrate means for interconnecting the upper and lower portions of the punch press.

From the description given thus far it should be readily apparent that a predetermined positional relationship between the depending member 14, or armature of the electrical power source for the punch press 10, and the inner oblong area 87 of the coil within which the magnetic field is generated, and in which the depending end 14 must project in order to produce an electric reaction, can be achieved by achieving proper positional relationship of the first connecting plate 24 to said second connecting plate 82. This, of course, follows from the fact that the operative chamber 87 of the solenoid coil 12 has a predetermined positional relationship which has been related to the second connecting plate 82 while the depending end 14 similarly has a predetermined positional relationship related to the first connecting plate 24. As best illustrated in FIG. 6, it is accordingly a part of the within invention to interconnect the first and second connecting plates 24, 82 with appropriate means at their interface, designated by the reference numeral 86, by an appropriate means which fixes or establishes the positions of these plates with respect to each other. As illustrated in FIG. 6, in the within preferred embodiment use is made of at least two locating pins 88 and 90 located generally centrally of the plates 24, 82. The pins 88 and 90 have their lower ends disposed in drilled openings 90 of the second connecting plate 82 and their upper ends in drilled openings 94 of the connecting plate 24.

Assuming the assembly of the punch press 10 which results in the die set 20 occupying a superposed position on top of the lower unit 22 and the pinned interconnection of the plates 24 and 82 to each other, the invention then contemplates firm attachment of the exchangeable components of the die set to the base unit 22. This is achieved by threadable engagement of bolts 96 and 98 to an appropriate one of the threaded bores 72–78 which align with the slots 26, 28 of the connecting plate 24 which effectively completes the clamping of the plate 24 to the plate 82.

Figure 7:
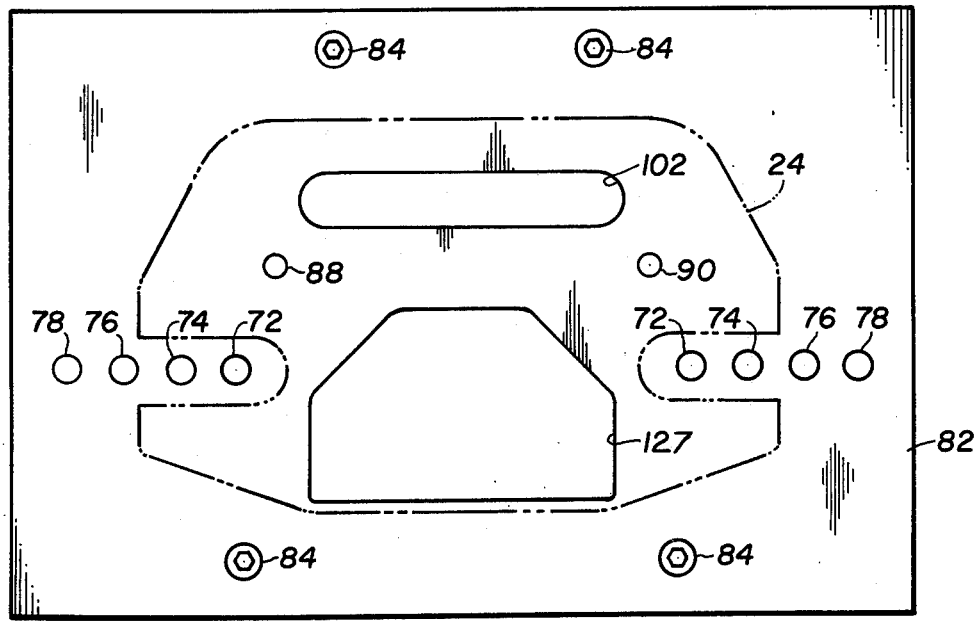
FIG. 7 is a plan view of the base portion of the punch press, the upper portion which is supported thereon being shown in phantom perspective.

To provide the necessary access of depending member 14 to the solenoid central chamber 87, the components which are located between the connection of member 14 to the tool holder 40 and the chamber 87 are appropriately provided with aligning openings. Thus, as illustrated in FIG. 7 the second connecting plate 82 has an appropriately sized and shaped oblong slot 102 machined or otherwise provided therein through which is projected the depending end 14 of the movement-transmitting member. In alignment with slot 102 is a similarly shaped and sized superposed arrangement of slots 104 and 106 in the first connecting plate 24 and anvil 34.

Assuming that the punch press 10 is in its assembled condition as described, energizing of the solenoid 12 will result in descending movement 16 in the movement-transmitting member 14 and thus corresponding movement in the tool holder 40 which provides the power stroke to this component of the die set 20. Following this, it will of course be understood that the solenoid 12 is de-energized, thus making it necessary to return the tool holder 40 to its raised clearance position with respect to the anvil 34. This is achieved in a noteworthy manner by the inner construction of the movement-transmitting member 14 which will now be described. More particularly, as is perhaps best illustrated in FIG. 2, located centrally of the member 14 is a central throughbore 108, the major upper length portion of which is counterbored, as at 110, and a headed pin 112 is disposed so as to project through the lower end of opening 108 and is maintained in this projected position by a compression spring 114 disposed in the counterbore 110. A threadably adjustable member 116 is threadably disposed completely through a threaded bore 118 in the tool holder 40 so that the lower end makes physical contact with a slidable plug 120 which is seated on top of the compression spring 114. Thus, by threadably adjusting the member 116, using its grip head 122, compression spring 114 is correspondingly compressed to provide any selected degree of urgency tending to maintain pin 112 in its extended relation from the counterbore 110.

Thus, following the power stroke 16 which brings the lower depending end 14 in surface contact against the surface 68, and which also forces the upper end of pin 112 within the counterbore 110 and causes further compression of the spring 114, when the solenoid 112 is de-energized, spring 114 then expands and in so doing causes lifting or ascending movement in the tool holder 40. This movement may be thought of as either the result of a force urgency raising the plug 120 or of forcing the pin 112 down against the surface 68.

To cushion the return of the depending end 14, elastomeric plugs 122, 124 are advantageously situated at the locations indicated. Also, to hold the adjusting member 116 against inadvertent rotational movement, use is made of a lock nut 127.

Figure 5:
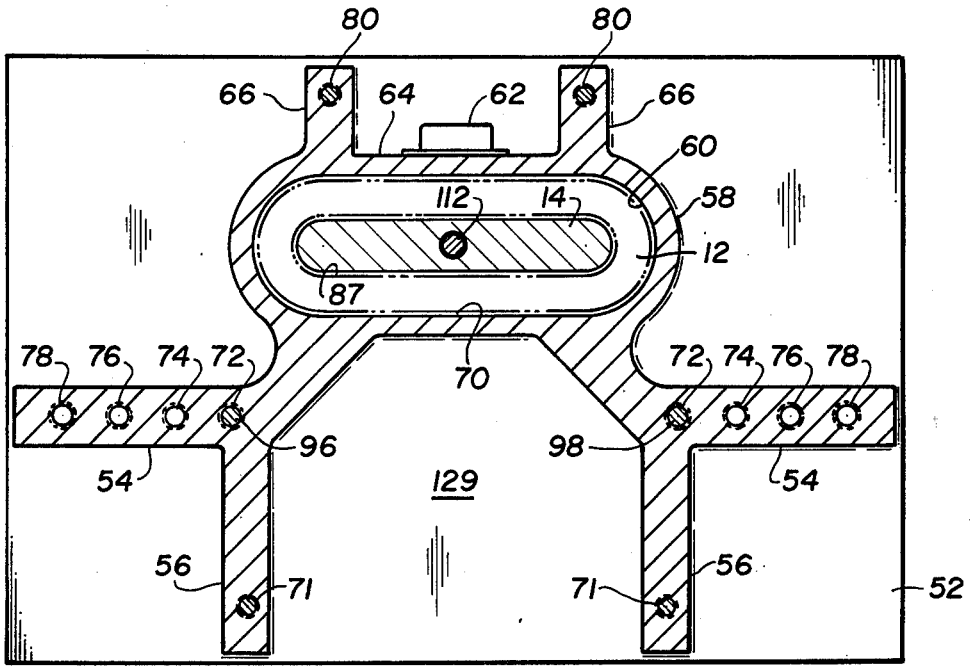
FIG. 5 is a plan view, in section, taken along line 5—5 of FIG. 2.

Aligned openings 127 (FIG. 1) and 128 (FIG. 4) appropriately machined in the first and second connecting plates 24 and 82 also cooperate to provide a discharge chute for scrap metal removed during use of the punch press 10. As best illustrated in FIG. 5, the removed scrap metal will fall by gravity through the aligned openings 127, 128 to a discharge area 129 delineated between the wall sections 56 of the base plate 52.

From the foregoing, it should be readily appreciated that there has been described herein an improved electrically actuated punch press in which the powering solenoid coil is stationary during functioning of the press and is located in the base of the unit. This allows use of a heavier and more powerful coil to provide correspondingly greater force to the powering stroke of the press. Moreover, although the coil is located in the stationary base 52 of the press, it is still relatively possible to achieve an accurate positioning relationship for the moving parts of the press and, in this connection, to achieve the necessary positional relationship between the depending end 14 of the movement-transmitting member and the solenoid coil 12, as well as achieving proper positional relationship between the anvil and tool holder, 34, 40, which are the interchangeable components of the die set 20 that forms the upper part of the punch press 10 hereof. More important, this necessary positional relationship between the component parts of the die set 20 is achieved even though different anvils and tool holders are selectively used in association with the connecting plate 24, since any one set selected is always accurately positioned since it is mounted over the locating and movement-guiding pins 30, 32. Also, as already explained, the resulting punch press 10 is readily assembled and disasembled, and constitutes a compact, portable machine tool having significant operating and performance capabilities not heretofore possible with known punch presses, even those adapted to be electrically actuated.

The second embodiment of a punch press according to the present invention is illustrated in FIGS. 8 and 9, to which reference is now made. To a great extent, the second embodiment contains structural features already described, and thus to avoid repetition these features will not be again described and can be recognized by their being designated by the same reference numerals used in connection with the first embodiment of FIGS. 1–7. Essentially, the second embodiment of a punch press 10 illustrated in FIGS. 8 and 9 differs from that already described in the fact that two additional solenoid coils 130 and 132 are utilized, the same cooperating with armatures in the form of the leader pins 30 and 32. For this embodiment to be operable it is of course also necessary that the leader pins 30 and 32 partake of descending movement simultaneously with the central movement-transmitting member 14. This is achieved by inserting all of these three moving parts through sleeve bearings which are each appropriately seated in counterbores in the anvil 34. The leader pins 30 and 32, like the member 40, are also appropriately sized lengthwise so that a lower depending end of each extends beneath the connecting plate 82 and into the oblong chambers of the center coil 131 and into the additional solenoid coils 130 and 132 respectively disposed in compartments 134 and 138.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention herein.

What is claimed is:

1. A compact, portable punch press comprising, in combination, a superposed positioned die set, a stroke-powering unit in supporting position beneath said die set, and connecting means for interconnecting said die set and stroke-powering unit together in a predetermined positional relation to each other; said die set comprising a first connecting plate having at least two locating and movement-guiding pins mounted in upstanding relation therefrom, an anvil having openings and disposed in an operative fixed relation adjacent said first connecting plate with said connecting plate pins projected through said anvil openings, a tool holder fixedly mounted adjacent the upper end of said pins in a clearance position from said anvil and in an operative fixed relation thereto as determined by said pins, and a movement-transmitting member connected in depending relation from said tool holder for urging said tool holder through descending and ascending movements along said pins during functional use of said die set; said stroke-powering unit comprising a base plate, and electrically operational solenoid coil and means mounting said coil in a fixed position on said base plate, and a second connecting plate mounted in covering relation over and in fixed positional relation to said solenoid coil; said connecting means comprising means located at the interface of said first and second connecting plates adapted to interconnect said plates together in a predetermined positional relation, whereby said depending movement-transmitting member is adapted to project within said solenoid coil for electrical reaction therewith due to the respective positional relationship of said depending member and said coil to said first and second connecting plates and said positional relation of said first and second connecting plates to each other.

2. A compact, portable punch press as claimed in claim 1 wherein said connecting means is comprised of at least two spaced pins, each disposed in part in strategically located openings in said first connecting plate and in part in strategically located openings in said second connecting plate, said locations of said openings being selected to provide said predetermined positional relationship to said connecting plates.

3. A compact, portable punch press as claimed in claim 1 wherein said second connecting plate has openings in aligned relation to said upstanding pins and said pins are sized to project through said openings in depending relation beneath said second connecting plate, and a cooperating additional solenoid coil is positioned for electrical reaction about each said pin depending end, to thereby supplement the force at which said tool holder is powered through its stroke by said stroke-powering unit.

4. A compact, portable punch press as claimed in claim 1 including a spring means operatively disposed in said depending member having an end projecting therefrom seated on said base plate, whereby during descending movement of said tool holder said spring means is compressed so as to be effective to then raise said tool holder through its ascending movement back to its starting position.

5. A compact, portable punch press as claimed in claim 4 including wall means on said base plate bounding a compartment for said solenoid coil, and a raised surface located centrally within said compartment functioning as said seat for said spring means, and wherein an annular channel is defined between said wall means and about said raised surface, said solenoid coil being adapted to be positioned in said annular channel in its said fixed position on said base plate and within said compartment.

6. A compact, portable punch press as claimed in claim 5 including aligned openings sized to accommodate said depending movement-transmitting member in each of said anvil, first and second connecting plates, to thereby provide both access for said depending member to said solenoid coil compartment and to assist in guiding said member during said descending and ascending movements thereof.

7. A compact, portable punch press as claimed in claim 6 including additional aligned openings in each of said first and second connecting plates, and in said stroke-powering unit base plate, and bolts adapted to project through said aligned openings for interconnecting said first, second and base plates together to thereby contribute to the rigidity of said assembled punch press.

8. A compact, portable punch press as claimed in claim 7 including further additional aligned openings in said anvil, first and second connecting plates so as to define a discharge path for scrap metal produced during said functional use of said die set, said path terminating at an out-of-the-way discharge point beneath said second connecting plate and said base plate.

* * * * *